US011373602B2

(12) United States Patent
Wang et al.

(10) Patent No.: US 11,373,602 B2
(45) Date of Patent: Jun. 28, 2022

(54) PIXEL CIRCUIT, METHOD AND APPARATUS FOR DRIVING THE SAME, ARRAY SUBSTRATE, AND DISPLAY APPARATUS

(71) Applicant: BOE TECHNOLOGY GROUP CO., LTD., Beijing (CN)

(72) Inventors: Tieshi Wang, Beijing (CN); Zhiqiang Xu, Beijing (CN); Xueling Gao, Beijing (CN); Chengchung Yang, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 310 days.

(21) Appl. No.: 16/605,794

(22) PCT Filed: May 13, 2019

(86) PCT No.: PCT/CN2019/086549
§ 371 (c)(1),
(2) Date: Oct. 16, 2019

(87) PCT Pub. No.: WO2019/218954
PCT Pub. Date: Nov. 21, 2019

(65) Prior Publication Data

US 2021/0407433 A1 Dec. 30, 2021

(30) Foreign Application Priority Data

May 17, 2018 (CN) ..... 201810474055.4

(51) Int. Cl.
*G09G 3/3275* (2016.01)
*G09G 3/3258* (2016.01)
*G09G 3/3233* (2016.01)

(52) U.S. Cl.
CPC ..... *G09G 3/3275* (2013.01); *G09G 3/3258* (2013.01); *G09G 3/3233* (2013.01);
(Continued)

(58) Field of Classification Search
CPC .. G09G 3/3275; G09G 3/3258; G09G 3/3233; G09G 2300/0852;
(Continued)

(56) References Cited

U.S. PATENT DOCUMENTS 10,909,926 B2 * 2/2021 Lin ..... G09G 3/32
2007/0152920 A1 * 7/2007 Yamashita ..... G09G 3/3233 345/76

(Continued)

FOREIGN PATENT DOCUMENTS

CN 1720568 A 1/2006
CN 1971695 A 5/2007

(Continued)

OTHER PUBLICATIONS

First Chinese Office Action dated Aug. 7, 2019, receieved for corresponding Chinese Application No. 201810474055.4, 30 pages.

*Primary Examiner* — Tom V Sheng
(74) *Attorney, Agent, or Firm* — Kinney & Lange, P.A.

(57) ABSTRACT

There are provided a pixel circuit and a method and apparatus for driving the same, an array substrate and a display apparatus. The pixel circuit includes: a driving sub-circuit and a switch sub-circuit coupled in series between a power signal terminal and a light emitting element, wherein the driving sub-circuit is configured to provide a driving signal to the light emitting element under control of a gate driving signal provided by a gate line, a data signal provided by a data line, and a power signal provided by a power signal terminal; and the switch sub-circuit is configured to control switch-on and switch-off of a signal path between the power (Continued)

signal terminal and the light emitting element under control of a switch signal provided by a switch signal terminal.

19 Claims, 8 Drawing Sheets

(52) U.S. Cl.
CPC ..... *G09G 2300/0819* (2013.01); *G09G 2300/0852* (2013.01); *G09G 2310/0237* (2013.01); *G09G 2320/0233* (2013.01); *G09G 2320/0257* (2013.01)

(58) Field of Classification Search
CPC ... G09G 2310/0237; G09G 2320/0233; G09G 2300/0819; G09G 2320/0257
USPC ..... 345/204
See application file for complete search history.

(56) References Cited

U.S. PATENT DOCUMENTS

2007/0247399 A1* 10/2007 Yamashita ..... G09G 3/3266 345/82
2008/0238909 A1* 10/2008 Yamashita ..... G09G 3/3233 345/211
2012/0105421 A1* 5/2012 Tsai ..... G09G 3/3233 345/212
2013/0300724 A1* 11/2013 Chaji ..... G09G 3/3283 345/212
2015/0348464 A1* 12/2015 In ..... G09G 3/2022 345/205
2016/0042688 A1* 2/2016 Goden ..... G03G 15/04054 347/118
2016/0307504 A1* 10/2016 Hung ..... G09G 3/3233
2016/0351126 A1* 12/2016 Qing ..... G09G 3/3258
2017/0365228 A1* 12/2017 Kwok ..... G02F 1/13624
2018/0240405 A1* 8/2018 Li ..... G09G 3/3406
2018/0301080 A1* 10/2018 Shigeta ..... G09G 3/3208
2019/0333447 A1* 10/2019 Yang ..... G09G 3/3233
2020/0251057 A1* 8/2020 Sun ..... G09G 3/3266
2021/0210016 A1* 7/2021 Li ..... G09G 3/3266

FOREIGN PATENT DOCUMENTS

CN 101147185 A 3/2008
CN 101458896 A 6/2009
CN 102054428 A 5/2011
CN 102376244 A 3/2012
CN 105679250 A 6/2016
CN 106710529 A 5/2017
CN 107068059 A 8/2017
CN 107481664 A 12/2017
CN 107909967 A 4/2018
CN 1080140489 A 5/2018
CN 108630151 A 10/2018

* cited by examiner

PIXEL CIRCUIT, METHOD AND APPARATUS FOR DRIVING THE SAME, ARRAY SUBSTRATE, AND DISPLAY APPARATUS

CROSS-REFERENCE TO RELATED APPLICATION(S)

The present application is the national phase of PCT Application No. PCT/CN2019/086549 filed on May 13, 2019, entitled "PIXEL CIRCUIT, METHOD AND APPARATUS FOR DRIVING THE SAME, ARRAY SUBSTRATE, AND DISPLAY APPARATUS", which claims priority to the Chinese Patent Application No. 201810474055.4, filed on May 17, 2018, entitled "PIXEL CIRCUIT, METHOD FOR DRIVING THE SAME, ARRAY SUBSTRATE, AND DISPLAY APPARATUS", which are incorporated herein by reference in their entireties.

TECHNICAL FIELD

The present disclosure relates to the field of display technology, and more particularly, to a pixel circuit, and a method and apparatus for driving the same, an array substrate, and a display apparatus.

BACKGROUND

A pixel circuit is a circuit in an Organic Light Emitting Diode (OLED) display apparatus for driving an OLED to emit light.

In the related art, a pixel circuit generally comprises a plurality of transistors and at least one capacitor. There is one driving transistor in the plurality of transistors, and the driving transistor may be used to control magnitude of current flowing through an OLED, thereby controlling light emitting brightness of the OLED. The capacitor is coupled to a gate of the driving transistor and is used to maintain a gate voltage of the driving transistor, so that the driving transistor is maintained to be in a switch-on state for a duration of one frame, thereby ensuring that the OLED continuously emits light.

SUMMARY

The present disclosure provides a pixel circuit and a method and apparatus for driving the same, an array substrate, and a display apparatus. The technical solutions are as follows.

In one aspect, there is provided a pixel circuit, comprising a driving sub-circuit and a switch sub-circuit, wherein the driving sub-circuit and the switch sub-circuit are coupled in series between a power signal terminal and a light emitting element;

the driving sub-circuit is further coupled to a gate line and a data line respectively, and is configured to provide a driving signal to the light emitting element under control of a gate driving signal provided by the gate line, a data signal provided by the data line, and a power signal provided by the power signal terminal; and the switch sub-circuit is further coupled to a switch signal terminal, and is configured to control switch-on and switch-off of a signal path between the power signal terminal and the light emitting element under control of a switch signal provided by the switch signal terminal.

Optionally, the power signal terminal is coupled to the switch sub-circuit, and the light emitting element is coupled to the driving sub-circuit.

Optionally, the switch sub-circuit comprises a switch transistor, wherein the switch transistor has a gate coupled to the switch signal terminal, a first terminal coupled to the power signal terminal, and a second terminal coupled to an input terminal of the driving sub-circuit.

Optionally, the power signal terminal is coupled to the driving sub-circuit, and the light emitting element is coupled to the switch sub-circuit.

Optionally, the switch sub-circuit comprises a switch transistor, wherein the switch transistor has a gate coupled to the switch signal terminal, a first terminal coupled to an output terminal of the driving sub-circuit, and a second terminal coupled to the light emitting element.

Optionally, the power signal terminal and the light emitting element are both coupled to the driving sub-circuit; and the driving sub-circuit comprises at least two transistors which are coupled in series, and the switch sub-circuit is coupled in series between the at least two transistors.

Optionally, the switch sub-circuit comprises a switch transistor, wherein the switch transistor has a gate coupled to the switch signal terminal, a first terminal coupled to a second terminal of one of the transistors, and a second terminal coupled to a first terminal of another of the transistors.

Optionally, the driving sub-circuit comprises a driving transistor, a first control transistor, a second control transistor, and a first capacitor, wherein the driving transistor, the second control transistor and a switch transistor contained in the switch sub-circuit are coupled in series between the power signal terminal and the light emitting element;

the first control transistor has a gate coupled to the gate line, a first terminal coupled to the data line, and a second terminal coupled to a gate of the driving transistor;

a gate of the second control transistor is coupled to a light emitting control signal terminal; and the first capacitor has one terminal coupled to the power signal terminal, and the other terminal coupled to the gate of the driving transistor.

Optionally, the driving sub-circuit comprises a third control transistor, a fourth control transistor, a fifth control transistor, a sixth control transistor, a seventh control transistor, an eighth control transistor, a second capacitor, and a driving transistor, wherein the driving transistor, the fourth control transistor, the seventh control transistor, and a switch transistor contained in the switch sub-circuit are coupled in series between the power signal terminal and the light emitting element;

the third control transistor has a gate coupled to the gate line, a first terminal coupled to the data line, and a second terminal coupled to a first terminal of the driving transistor;

a gate of the fourth control transistor is coupled to a light emitting control signal terminal;

the fifth control transistor has a gate coupled to the gate line, a first terminal coupled to a second terminal of the driving transistor, and a second terminal coupled to a gate of the driving transistor;

the sixth control transistor has a gate coupled to a reset signal terminal, a first terminal coupled to an initialization signal terminal, and a second terminal coupled to the gate of the driving transistor;

a gate of the seventh control transistor is coupled to the light emitting control signal terminal;

the eighth control transistor has a gate coupled to the gate line, a first terminal coupled to the initialization signal terminal, and a second terminal coupled to a second terminal of the seventh control transistor; and the second capacitor has one terminal coupled to the gate of the driving transistor, and the other terminal coupled to the power signal terminal.

In another aspect, there is provided a method for driving a pixel circuit, which may be used to drive the pixel circuit described in the above aspect, the method comprising:

providing, in a light emitting phase, a switch signal at a first potential to a switch signal terminal, controlling, by a switch sub-circuit, a signal path between a power signal terminal and a light emitting element to be switched on under control of the switch signal, performing, by a driving sub-circuit, driving under driving of a gate driving signal provided by a gate line, a data signal provided by a data line and a power signal provided by the power signal terminal, and emitting, by the light emitting element, light, wherein a display image corresponding to the data signal is a dynamic image; and providing, in a control phase, a switch signal at a second potential to the switch signal terminal, controlling, by the switch sub-circuit, the signal path between the power signal terminal and the light emitting element to be switched off under control of the switch signal, and stopping, by the light emitting element, emitting light.

Optionally, before the light emitting phase, the method further comprises:

detecting whether the display image corresponding to the data signal is a dynamic image; and when the display image is a dynamic image, performing the light emitting phase and the control phase sequentially.

When the display image is a dynamic image, before the light emitting phase, the method further comprises:

adjusting a voltage value of the data signal according to a ratio of a duration of the control phase to a duration of the light emitting phase.

Optionally, adjusting a voltage value of the data signal according to a ratio of a duration of the control phase to a duration of the light emitting phase comprises:

determining, according to a conversion relationship between grayscales and brightness values, a brightness value corresponding to a display grayscale of the data signal;

adjusting the brightness value according to the ratio of the duration of the control phase to the duration of the light emitting phase; and adjusting the voltage value of the data signal based on a display grayscale corresponding to the adjusted brightness value.

Optionally, before the light emitting phase, the method further comprises:

providing, in an input phase, a gate driving signal at the first potential to a gate line, providing the data signal to the data line, and storing, by the driving sub-circuit, the data signal under control of the gate driving signal.

In yet another aspect, there is provided an apparatus for driving a pixel circuit, applied to implement the method described in the above aspect.

In a further aspect, there is provided an array substrate, comprising a plurality of pixel units arranged in an array, each of the pixel units comprising a pixel circuit and a light emitting element coupled to the pixel circuit, wherein a pixel circuit in at least one of the plurality of pixel units is the pixel circuit described in the above aspect.

Optionally, a pixel circuit in each of the plurality of pixel units is the pixel circuit described in the above aspect;

the array substrate comprises a plurality of control regions, each of the control regions has at least one of the pixel units provided therein, each of the control regions has one switch signal line provided therein, each switch signal line is coupled to one switch signal terminal, and different switch signal lines are coupled to different switch signal terminals; and at least one of the pixel units provided in each of the control regions comprises pixel circuits coupled to one switch signal line provided in the control region.

Optionally, the plurality of control regions are arranged in an array. Each of the switch signal lines is provided in parallel with a data line in the array substrate.

In still another aspect, there is provided a display apparatus comprising the array substrate described in the above aspect and the driving apparatus described in the above aspect.

BRIEF DESCRIPTION OF THE ACCOMPANYING DRAWINGS

In order to more clearly illustrate the technical solutions in the embodiments of the present disclosure, the accompanying drawings required to be used in the description of the embodiments will be briefly described below. It is obvious that the accompanying drawings in the following description are only some embodiments of the present disclosure. Other accompanying drawings may also be obtained by those of ordinary skill in the art according to these accompanying drawings without any creative work.

DETAILED DESCRIPTION

In order to make the purposes, technical solutions and advantages of the present disclosure more clear, the embodiments of the present disclosure will be further described in detail below with reference to the accompanying drawings.

Transistors used in all embodiments of the present disclosure may be thin film transistors or field effect transistors or other devices having the same characteristics, and the transistors used in the embodiments of the present disclosure are mainly switch transistors according to functions thereof in a circuit. Since a source and a drain of a switch transistor used here are symmetrical, the source and the drain are interchangeable. In the embodiments of the present disclosure, the source is referred to as a first terminal, and the drain is referred to as a second terminal, or the drain is referred to as a first terminal, and the source is referred to as a second terminal. According to a form in the accompanying drawings, an intermediate terminal of a transistor is a gate, a signal input terminal of the transistor is a source, and a signal output terminal of the transistor is a drain. In addition, each of the switch transistors used in the embodiments of the present disclosure may comprise any of a P-type switch transistor and an N-type switch transistor, wherein the P-type switch transistor is switched on when a gate thereof is at a low level and is switched off when the gate is at a high level, and the N-type switch transistor is switched on when a gate thereof is at a high level and is switched off when the gate is at a low level. Further, in various embodiments of the present disclosure, each of a plurality of signals corresponds to a first potential and a second potential. The first potential and the second potential only means that the potential of the signal has two state quantities, and do not mean that the first potential or the second potential has a specific value throughout the present application.

In the related art, capacitance in a pixel circuit may maintain a gate voltage of a driving transistor, so that the driving transistor is maintained to be in a switch-on state for a duration of one frame, thereby ensuring that an OLED continuously emits light. Therefore, when a display picture displayed by a display apparatus changes rapidly, due to a visual persistence effect of human eyes and a holding mode of the display device, dynamic smear may be present in the display picture viewed by the human eyes, and the display apparatus may have a poor display effect.

Figure 1:
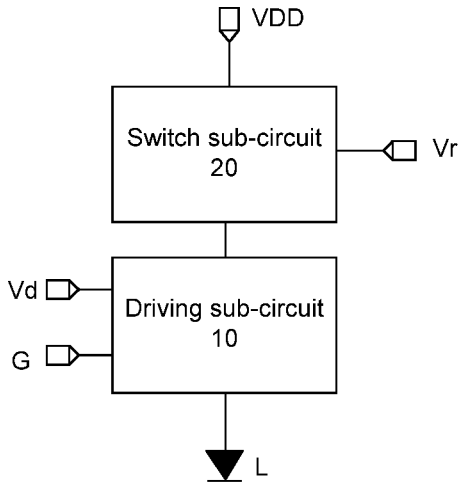
FIG. 1 is a schematic structural diagram of a pixel circuit according to an embodiment of the present disclosure.

FIG. 1 is a schematic structural diagram of a pixel circuit according to an embodiment of the present disclosure. As shown in FIG. 1, the pixel circuit may comprise a driving sub-circuit 10 and a switch sub-circuit 20.

The driving sub-circuit 10 and the switch sub-circuit 20 are coupled in series between a power signal terminal VDD and a light emitting element L.

As shown in FIG. 1, the driving sub-circuit 10 is further coupled to a gate line G and a data line Vd respectively. The driving sub-circuit 10 may be configured to provide a driving signal to the light emitting element L to drive the light emitting element L to emit light under control of a gate driving signal provided by the gate line G, a data signal provided by the data line Vd and a power signal provided by the power signal terminal VDD.

The switch sub-circuit 20 is further coupled to a switch signal terminal Vr, and may be configured to control switch-on and switch-off of a signal path between the power signal terminal VDD and the light emitting element L under control of a switch signal provided by the switch signal terminal Vr.

For example, the switch sub-circuit 20 may control the signal path between the power signal terminal VDD and the light emitting element L to be switched on when the switch signal is at a first potential, so that the driving sub-circuit 10 may provide a driving signal to the light emitting element L to drive the light emitting element L to emit light. The switch sub-circuit 20 may further control the signal path between the power signal terminal VDD and the light emitting element L to be switched off when the switch signal is at a second potential, and at this time, the driving sub-circuit 10 may not generate the driving signal or may generate the driving signal which may not be output to the light emitting element L, and the light emitting element L may not emit light.

Optionally, in the embodiment of the present disclosure, the driving sub-circuit 10 may comprise a driving transistor M0, which may be configured to provide driving current to the light emitting element L under driving of the gate driving signal, the data signal, and the power signal. The switch sub-circuit 20 may be coupled in series with the driving transistor M0. For example, the switch sub-circuit 20 may be coupled to a first terminal or a second terminal of the driving transistor M0. The coupling may refer to direct coupling, or may also refer to indirect coupling through other transistors, which is not limited in the embodiment of the present disclosure.

In summary, the embodiments of the present disclosure provide a pixel circuit comprising a switch sub-circuit coupled in series with a driving sub-circuit, wherein the switch sub-circuit may control switch-on and switch-off of the path between the power signal terminal and the light emitting element under control of the switch signal provided by the switch signal terminal. Therefore, when the image displayed by the display apparatus is a dynamic image, the signal path between the power signal terminal and the light emitting element may be controlled to be switched off through the switch signal to reduce the duration in which the light emitting element emits light, which may avoid the occurrence of dynamic smear, thereby ensuring a display effect of the display apparatus.

As an optional implementation, as shown in FIG. 1, an input terminal of the switch sub-circuit 20 may be coupled to the power signal terminal VDD, an output terminal of the switch sub-circuit 20 may be coupled to an input terminal of the driving sub-circuit 10, an output terminal of the driving sub-circuit 10 is coupled to one terminal (for example, an anode) of the light emitting element L, and the other terminal (for example, a cathode) of the light emitting element L may be coupled to a direct current power terminal VSS (not shown in FIG. 1).

Figure 2:
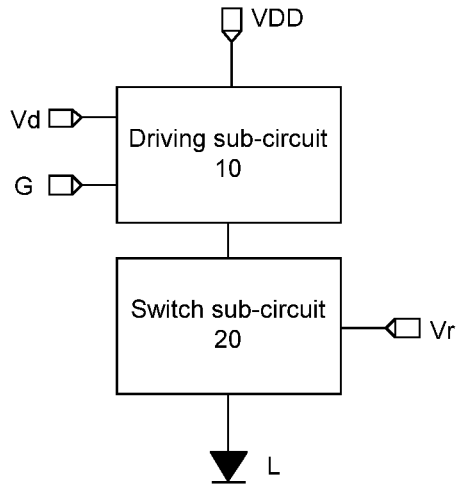
FIG. 2 is a schematic structural diagram of another pixel circuit according to an embodiment of the present disclosure.

FIG. 2 is a schematic structural diagram of another pixel circuit according to an embodiment of the present disclosure. As shown in FIG. 2, as another optional implementation, the input terminal of the driving sub-circuit 10 may be coupled to the power signal terminal VDD, the output terminal of the driving sub-circuit 10 is coupled to the input terminal of the switch sub-circuit 20, the output terminal of the switch sub-circuit 20 is coupled to one terminal of the light emitting element L, and the other terminal of the light emitting element L may be coupled to the direct current power terminal VSS.

Figure 3:
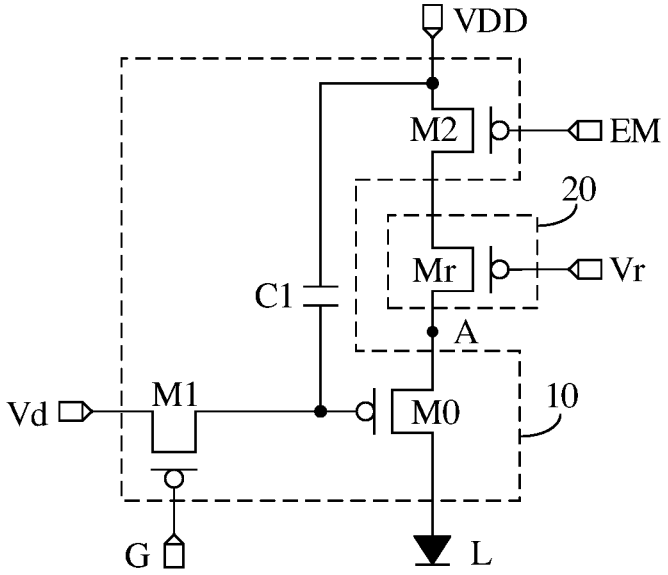
FIG. 3 is a schematic structural diagram of yet another pixel circuit according to an embodiment of the present disclosure.

FIG. 3 is a schematic structural diagram of yet another pixel circuit according to an embodiment of the present disclosure. As shown in FIG. 3, as yet another optional implementation, the input terminal of the driving sub-circuit 10 is coupled to the power signal terminal VDD, and the output terminal of the driving sub-circuit 10 is coupled to one terminal of the light emitting element L. In this implementation, the driving sub-circuit 10 may comprise at least two transistors which are connected in series, and the switch sub-circuit 20 may be coupled in series between the at least two transistors.

As shown in FIG. 3, the switch sub-circuit 20 may comprise a switch transistor Mr having a gate coupled to the switch signal terminal Vr.

A first terminal of the switch transistor Mr may be coupled to a second terminal of one transistor in the driving sub-circuit 10, for example, a second terminal of a second control transistor M2 in the driving sub-circuit 10. A second terminal of the switch transistor Mr may be coupled to a first terminal of another transistor in the driving sub-circuit 10, for example, a first terminal of the driving transistor M0 in the driving sub-circuit 10.

In the pixel circuit shown in FIG. 3, the first terminal of the second transistor M2 is the input terminal of the driving sub-circuit 10, and the second terminal of the driving transistor M0 is the output terminal of the driving sub-circuit 10.

Figure 4:
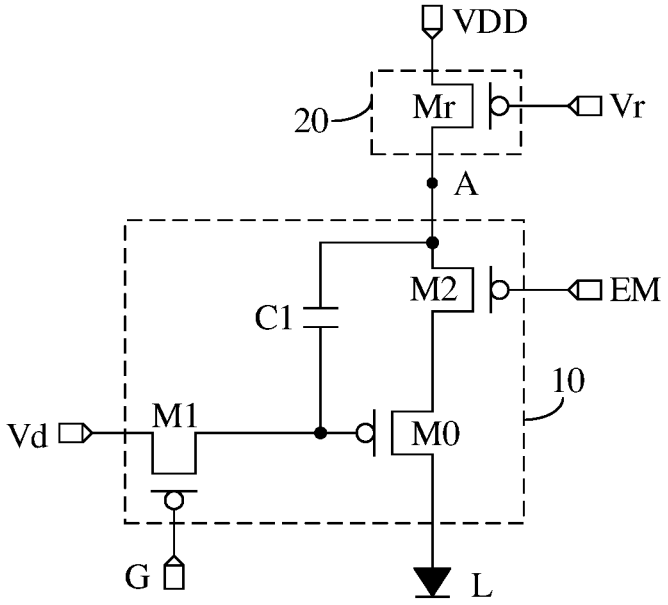
FIG. 4 is a schematic structural diagram of still another pixel circuit according to an embodiment of the present disclosure.

For the structure of the pixel circuit shown in FIG. 1, as shown in FIG. 4, the first terminal of the switch transistor Mr may be coupled as the input terminal of the switch sub-circuit 20 to the power signal terminal VDD, and the second terminal of the switch transistor Mr may be coupled as the output terminal of the switch sub-circuit 20 to the input terminal of the driving sub-circuit 10, for example a first terminal of the second control transistor M2 in the driving sub-circuit 10. Correspondingly, the second terminal of the driving transistor M0 may be coupled as the output terminal of the driving sub-circuit 10 to one terminal of the light emitting element L.

Figure 5:
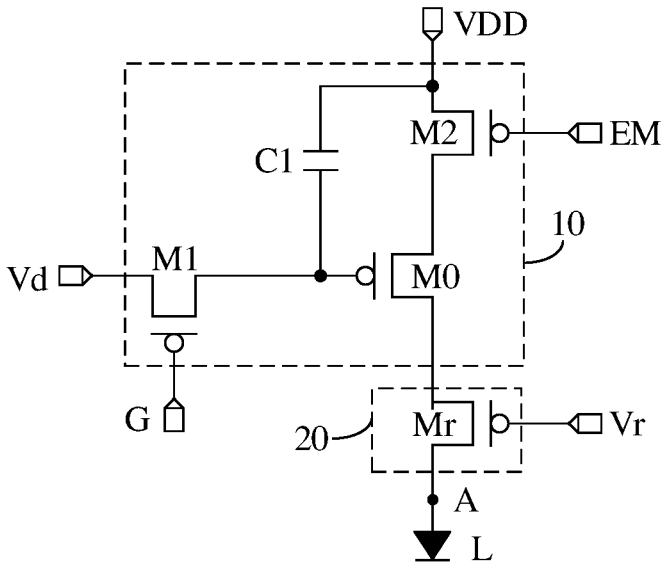
FIG. 5 is a schematic structural diagram of still another pixel circuit according to an embodiment of the present disclosure.

For the structure of the pixel circuit shown in FIG. 2, as shown in FIG. 5, the first terminal of the switch transistor Mr may be coupled as the input terminal of the switch sub-circuit 20 to the output terminal of the driving sub-circuit 10, for example, the second terminal of the driving transistor M0 in the driving sub-circuit 10. The second terminal of the switch transistor Mr may be coupled as the output terminal of the switch sub-circuit 20 to the light emitting element L.

As shown in FIG. 5, the second control transistor M2 in the driving sub-circuit 10 may be coupled as the input terminal of the driving sub-circuit 10 to the power signal terminal VDD.

In the embodiment of the present disclosure, when the switch signal is at the first potential, the switch transistor Mr is switched on, the signal path between the power signal terminal VDD and the light emitting element L is switched on, and at this time, the driving sub-circuit 10 may normally drive the light emitting element L to emit light. When the switch signal is at the second potential, the switch transistor Mr is switched off, the signal path between the power signal terminal VDD and the light emitting element L is switched off, and at this time, no driving current flows through the light emitting element L, and the light emitting element L stops emitting light.

For example, when the switch transistor Mr is a P-type transistor, the first potential may be a low potential with respect to the second potential. Further, the second potential may be greater than a potential of the power signal provided by the power signal terminal VDD.

In an optional implementation of the embodiment of the present disclosure, the driving sub-circuit 10 may comprise three transistors and one capacitor, that is, the driving sub-circuit 10 may adopt a 3T1C structure. As shown in FIGS. 3 to 5, the driving sub-circuit 10 may comprise a first control transistor M1, the second control transistor M2, the driving transistor M0, and a first capacitor C1.

Here, the driving transistor M0, the second control transistor M2, and the switch transistor Mr contained in the switch sub-circuit 20 may be coupled in series between the power signal terminal VDD and the light emitting element L.

As shown in FIGS. 3 and 5, the first control transistor M1 has a gate coupled to the gate line G, a first terminal coupled to the data line Vd, and a second terminal coupled to a gate of the driving transistor M0.

The second control transistor M2 has a gate coupled to the light emitting control signal terminal EM, and the first terminal and the second terminal coupled in series with the driving transistor M0 and the switch transistor Mr between the power signal terminal VDD and the light emitting element L.

For example, in the structure shown in FIG. 3, the second control transistor M2, the switch transistor Mr, and the driving transistor M0 are sequentially coupled in series. The first terminal of the second control transistor M2 is coupled to the power signal terminal VDD, and the second terminal of the second control transistor M2 is coupled to the first terminal of the switch transistor Mr.

In the structure shown in FIG. 4, the switch transistor Mr, the second control transistor M2, and the driving transistor M0 are sequentially coupled in series. The first terminal of the second control transistor M2 is coupled to the second terminal of the switch transistor Mr, and the second terminal of the second control transistor M2 is coupled to the first terminal of the switch transistor Mr.

In the structure shown in FIG. 5, the second control transistor M2, the driving transistor M0, and the switch transistor Mr are sequentially coupled in series. The first terminal of the second control transistor M2 is coupled to the power signal terminal VDD, and the second terminal of the second control transistor M2 is coupled to the first terminal of the driving transistor M0.

As may be seen from FIGS. 3 to 5, the first capacitor C1 has one terminal coupled to the power signal terminal VDD, and the other terminal coupled to the gate of the driving transistor M0.

Figure 6:
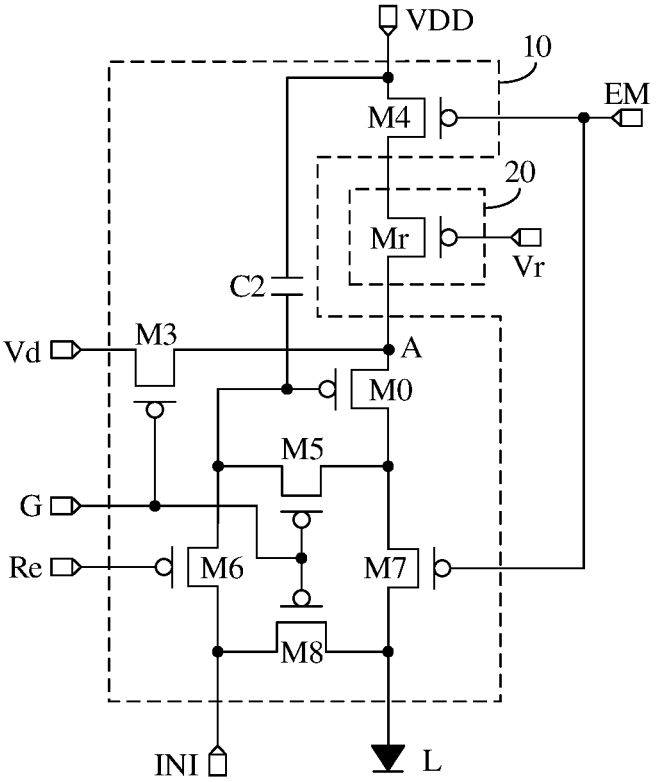
FIG. 6 is a schematic structural diagram of still another pixel circuit according to an embodiment of the present disclosure.
Figure 7:
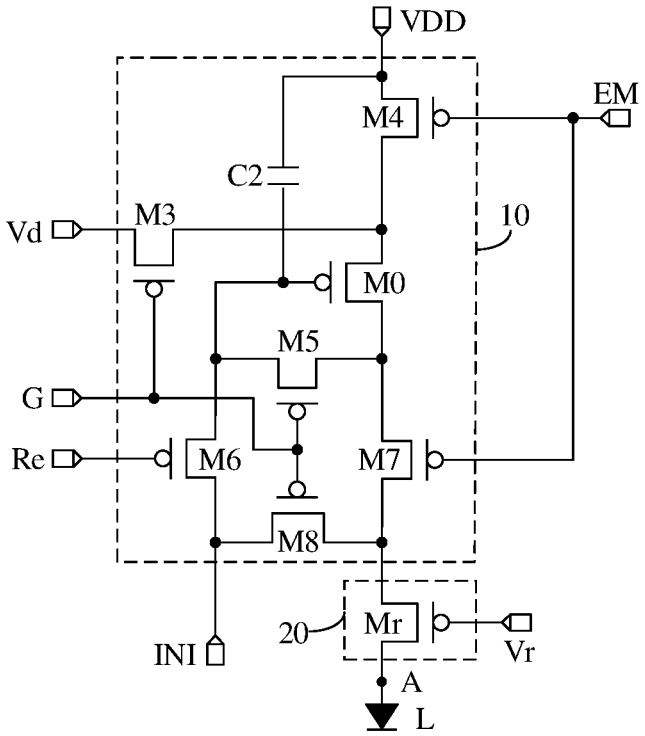
FIG. 7 is a schematic structural diagram of still another pixel circuit according to an embodiment of the present disclosure.

In another optional implementation of the embodiment of the present disclosure, the driving sub-circuit 10 may also comprise seven transistors and one capacitor, that is, the driving sub-circuit 10 may adopt a 7T1C structure. As shown in FIGS. 6 and 7, the driving sub-circuit 10 may comprise: a third control transistor M3, a fourth control transistor M4, a fifth control transistor M5, a sixth control transistor M6, a seventh control transistor M7, an eighth control transistor M8, a second capacitor C2 and the driving transistor M0.

Here, the driving transistor M0, the fourth control transistor M4, the seventh control transistor M7, and the switch transistor Mr contained in the switch sub-circuit 20 are coupled in series between the power signal terminal VDD and the light emitting element L.

As shown in FIGS. 6 and 7, the third control transistor M3 has a gate coupled to the gate line G, a first terminal coupled to the data line Vd, and a second terminal coupled to the first terminal of the driving transistor M0.

A gate of the fourth control transistor M4 is coupled to the light emitting control signal terminal EM.

The fifth control transistor M5 has a gate coupled to the gate line G, a first terminal coupled to the second terminal of the driving transistor M0, and a second terminal coupled to the gate of the driving transistor M0.

The sixth control transistor M6 has a gate coupled to a reset signal terminal Re, a first terminal coupled to an initialization signal terminal INI, and a second terminal coupled to the gate of the driving transistor M0.

A gate of the seventh control transistor M7 is coupled to the light emitting control signal terminal EM.

The eighth control transistor M8 has a gate coupled to the gate line G, a first terminal coupled to the initialization signal terminal INI, and a second terminal coupled to a second terminal of the seventh control transistor M7.

The second capacitor C2 has one terminal coupled to the gate of the driving transistor M0, and the other terminal coupled to the power signal terminal VDD.

As an optional implementation, as shown in FIG. 6, the fourth control transistor M4, the switch transistor Mr, the driving transistor M0, and the seventh control transistor M7 may be sequentially coupled in series. That is, the first terminal of the fourth control transistor M4 is directly coupled to the power signal terminal VDD, the second terminal of the fourth control transistor M4 is coupled to the first terminal of the switch transistor Mr, the second terminal of the switch transistor Mr is coupled to the first terminal of the driving transistor M0, the second terminal of the driving transistor M0 is coupled to the first terminal of the seventh control transistor M7, and the second terminal of the seventh control transistor M7 is coupled to the light emitting element L.

As another optional implementation, as shown in FIG. 7, the fourth control transistor M4, the driving transistor M0, the seventh control transistor M7, and the switch transistor Mr may be sequentially coupled in series. That is, the first terminal of the fourth control transistor M4 is directly coupled to the power signal terminal VDD, the second terminal of the fourth control transistor M4 is coupled to the first terminal of the driving transistor M0, the second terminal of the driving transistor M0 is coupled to the first terminal of the seventh control transistor M7, the second terminal of the seventh control transistor M7 is coupled to the first terminal of the switch transistor Mr, and the second terminal of the switch transistor Mr is coupled to the light emitting element L.

As a further optional implementation, the switch transistor Mr, the fourth control transistor M4, the driving transistor M0, and the seventh control transistor M7 may be coupled in series. That is, the first terminal of the switch transistor Mr is directly coupled to the power signal terminal VDD, the second terminal of the switch transistor Mr is coupled to the first terminal of the fourth control transistor M4, the second terminal of the fourth control transistor M4 is coupled to the first terminal of the driving transistor M0, the second terminal of the driving transistor M0 is coupled to the first terminal of the seventh control transistor M7, and the second terminal of the seventh control transistor M7 is coupled to the light emitting element L.

As a further optional implementation, the fourth control transistor M4, the driving transistor M0, the switch transistor Mr, and the seventh control transistor M7 may be coupled in series. That is, the first terminal of the fourth control transistor M4 is directly coupled to the power signal terminal VDD, the second terminal of the fourth control transistor M4 is coupled to the first terminal of the driving transistor M0, the second terminal of the driving transistor M0 is coupled to the first terminal of the switch transistor Mr, the second terminal of the switch transistor Mr is coupled to the first terminal of the seventh control transistor M7, and the second terminal of the seventh control transistor M7 is coupled to the light emitting element L.

It should be illustrated that types of the transistors in the pixel circuit according to the embodiments of the present disclosure may all be N-type transistors or may also all be P-type transistors, which is not limited in the embodiments of the present disclosure. Further, in addition to the 3T1C structure shown in FIGS. 3 to 5 or the 7T1C structure shown in FIG. 6 or FIG. 7, the driving sub-circuit in the pixel circuit may also adopt other structures as long as it is ensured that the driving sub-circuit is coupled in series with the switch sub-circuit, and the structure of the driving sub-circuit is not limited in the embodiments of the present disclosure.

In summary, the embodiments of the present disclosure provide a pixel circuit comprising a switch sub-circuit coupled in series with a driving sub-circuit, wherein the switch sub-circuit may control switch-on and switch-off of the path between the power signal terminal and the light emitting element under control of the switch signal provided by the switch signal terminal. Therefore, when an image displayed by the display apparatus is a dynamic image, the signal path between the power signal terminal and the light emitting element may be controlled to be switched off through the switch signal to reduce the duration in which the light emitting element emits light, which may avoid the occurrence of dynamic smear, thereby ensuring a display effect of the display apparatus.

Figure 8:
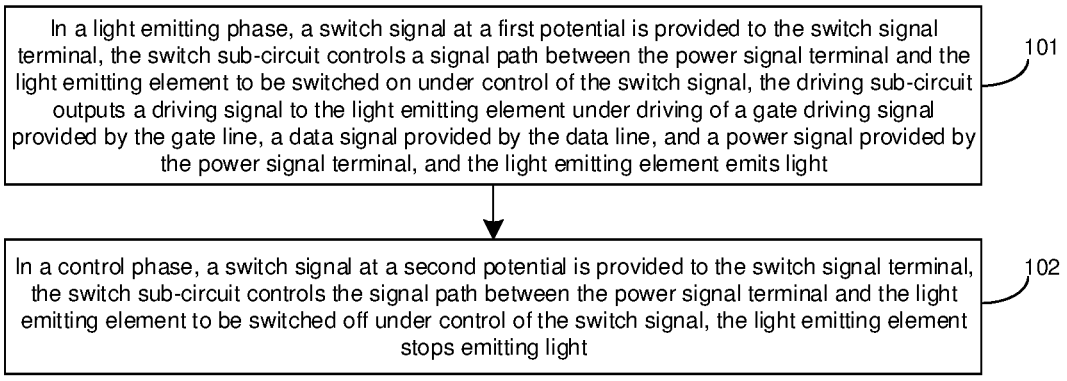
FIG. 8 is a flowchart of a method for driving a pixel circuit according to an embodiment of the present disclosure.

FIG. 8 is a flowchart of a method for driving a pixel circuit according to an embodiment of the present disclosure, which may be used to drive the pixel circuit as shown in any of FIGS. 1 to 7. As shown in FIG. 8, the method may comprise the following steps.

In step 101, in a light emitting phase, a switch signal at a first potential is provided to the switch signal terminal, the switch sub-circuit controls a signal path between the power signal terminal and the light emitting element to be switched on under control of the switch signal, the driving sub-circuit outputs a driving signal to the light emitting element under driving of a gate driving signal provided by the gate line, a data signal provided by the data line, and a power signal provided by the power signal terminal, and the light emitting element emits light.

Here, a display image corresponding to the data signal may be a dynamic image. In the embodiment of the present disclosure, a driving apparatus (for example, a timing controller) in the display apparatus may compare a data signal at a current frame with a data signal at a previous frame. When the driving apparatus detects that a difference value between the two data signals is greater than a preset threshold, it may be determined that a display image corresponding to the data signal at the current frame is a dynamic image, and a control phase shown in step 102 below may be performed after the light emitting phase. Optionally, the driving apparatus may compare the data signal at the current frame with data signals at a number of previous frames respectively, and when it is detected that a difference value between the data signal at the current frame with a data signal at any previous frame is greater than a preset threshold, it may be determined that the display image corresponding to the data signal at the current frame is a dynamic image, and the control phase shown in step 102 below may be performed after the light emitting phase.

In step 102, in the control phase, a switch signal at a second potential is provided to the switch signal terminal, the switch sub-circuit controls the signal path between the power signal terminal and the light emitting element to be switched off under control of the switch signal, the light emitting element stops emitting light.

In summary, the embodiments of the present disclosure provide a method for driving a pixel circuit, which may firstly control the light emitting element to emit light through the driving sub-circuit and the switch sub-circuit and then control the light emitting element to stop emitting light through the switch sub-circuit when the display image corresponding to the data signal provided by the data line is a dynamic image, which may reduce the duration in which the light emitting element emits light, and thus may avoid the occurrence of dynamic smear, thereby ensuring a display effect of the display apparatus.

Figure 9:
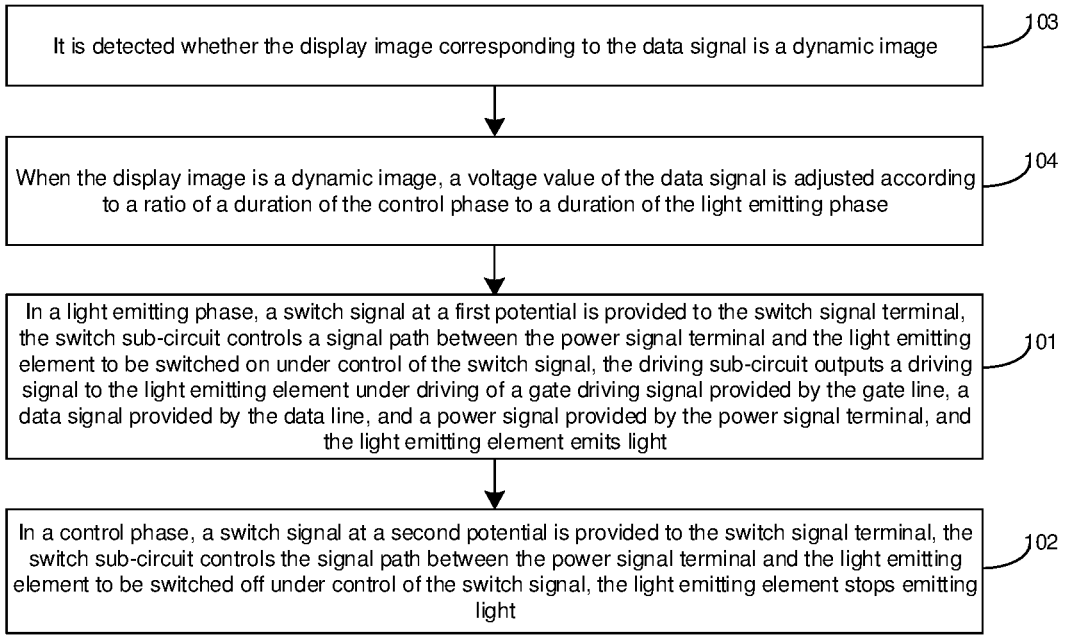
FIG. 9 is a flowchart of another method for driving a pixel circuit according to an embodiment of the present disclosure.

Optionally, FIG. 9 is a flowchart of another driving method according to an embodiment of the present disclosure. As shown in FIG. 9, before the light emitting phase shown in step 101 above, the method may further comprise the following steps.

In step 103, it is detected whether the display image corresponding to the data signal is a dynamic image.

In the embodiment of the present disclosure, after acquiring a data signal (also referred to as material) of one frame which is currently to be written into a certain pixel unit, the driving apparatus in the display apparatus may firstly detect whether a display image corresponding to the data signal is a dynamic image. When the display image corresponding to the data signal is a dynamic image, step 104 may be performed, and then the light emitting phase shown in step 101 and the control phase shown in step 102 are sequentially performed. When the display image corresponding to the data signal is not a dynamic image, step 101 may be directly performed, and step 102 is not performed again.

That is, when a display image corresponding to a data signal of one frame which is currently to be written into a certain pixel unit is a dynamic image, a pixel circuit of the pixel unit may control a light emitting element to emit light for a period of time and then stop emitting light within a display duration of one frame, i.e., reducing a duty ratio of the light emitting phase within the display duration of one frame. When the display image corresponding to the data signal at the current frame is not a dynamic image, the pixel circuit of the pixel unit may control the light emitting element to continuously emit light within the display duration of one frame.

In step 104, when the display image is a dynamic image, a voltage value of the data signal is adjusted according to a ratio of a duration of the control phase to a duration of the light emitting phase.

When a display image to be displayed by a certain pixel unit is a dynamic image, since the driving apparatus may control a light emitting element of the pixel unit to emit light for a period of time and then stop emitting light through a pixel circuit of the pixel unit, compared with other pixel units which display a non-dynamic image, a light emitting duration of the pixel unit which displays the dynamic image may decrease. In order to ensure the uniformity of the display brightness of the display apparatus, for the pixel unit which displays the dynamic image, the driving apparatus may compensate for the voltage value of the data signal to be written into the pixel unit, so as to improve the brightness of the light emitting element in the pixel unit.

Optionally, the driving apparatus may adjust the voltage value of the data signal according to a ratio of a duration of the control phase to a duration of the light emitting phase. Further, magnitude of an adjustment value of the voltage value of the data signal is positively correlated with magnitude of the ratio. That is, the longer the duration of the control phase is, the greater the ratio is, and the greater the amplitude of the adjustment value of the voltage value of the data signal is; and the shorter the duration of the control phase is, the less the ratio is, and the less the amplitude of the adjustment value of the voltage value of the data signal is.

Figure 10:
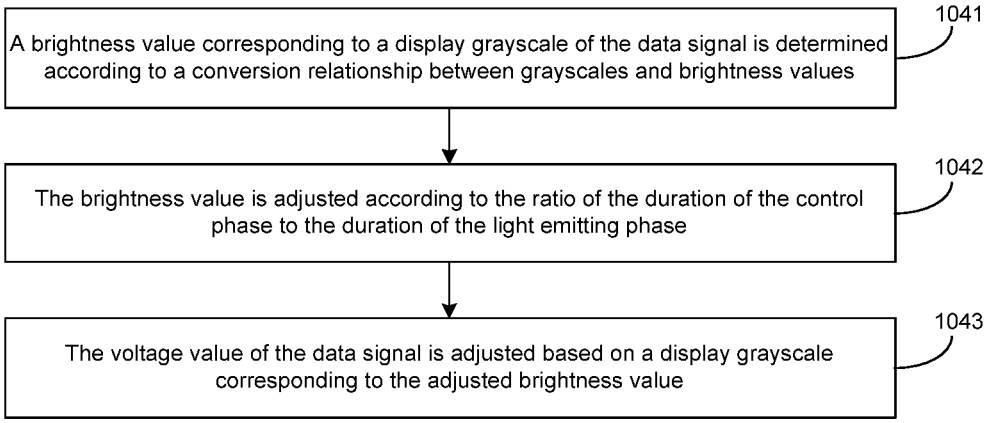
FIG. 10 is a flowchart of a method for adjusting a voltage value of a data signal according to an embodiment of the present disclosure.

For example, FIG. 10 is a flowchart of a method for adjusting a voltage value of a data signal according to an embodiment of the present disclosure. As shown in FIG. 10, the method may comprise the following steps.

In step 1041, a brightness value corresponding to a display grayscale of the data signal is determined according to a conversion relationship between grayscales and brightness values.

In the embodiment of the present disclosure, the driving apparatus of the display apparatus may calculate a brightness value corresponding to a display grayscale of the data signal at the current frame according to the preset conversion relationship between grayscales and brightness values. For example, the conversion relationship between grayscales and brightness values may be represented by a gamma curve. The gamma curve may be used to indicate display brightness of each pixel unit at different grayscales. Currently, a commonly-used gamma curve is generally a gamma 2.2 curve, that is, a brightness value of a pixel unit is 2.2 power of a grayscale.

In step 1042, the brightness value is adjusted according to the ratio of the duration of the control phase to the duration of the light emitting phase.

Further, the driving apparatus may adjust the brightness value according to the ratio of the duration of the control phase to the duration of the light emitting phase, that is, increase the brightness value. In addition, the magnitude of the adjustment value of the brightness value is positively correlated with the magnitude of the ratio. That is, the longer the duration of the control phase is, the greater the amplitude of the adjustment value of the brightness value is.

For example, it is assumed that the ratio of the duration of the control phase to the duration of the light emitting phase is 3:1, that is, the duration of the current light emitting phase of the pixel unit is ¼ of a light emitting duration in a normal condition. Therefore, in order to compensate for the light emitting brightness of the pixel unit, the brightness value may be adjusted to four times of the original brightness value.

Figure 11:
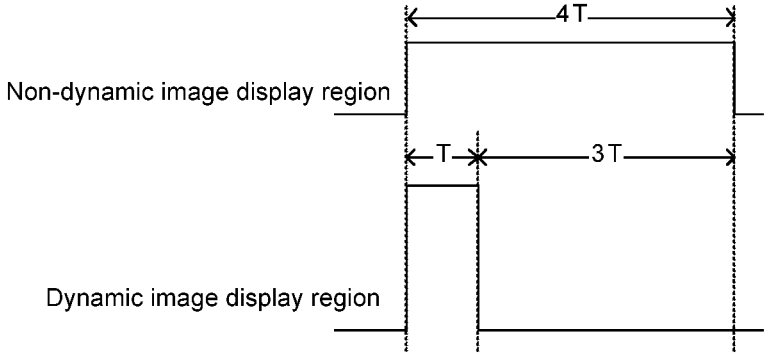
FIG. 11 is a schematic diagram of durations in which a pixel unit emits light in a dynamic image display region and a non-dynamic image display region according to an embodiment of the present disclosure.

FIG. 11 is a schematic diagram of light emitting durations of a pixel unit in a dynamic image display region and a non-dynamic image display region according to an embodiment of the present disclosure. As may be seen from FIG. 11, the pixel unit in the non-dynamic image display region may have a light emitting duration (i.e., a duration of the light emitting phase) of 4T within a display duration of one frame, and the pixel unit in the dynamic image display region may have a light emitting duration of T within the display duration of one frame, i.e., ¼ of the original light emitting duration. Further, as may also be seen from FIG. 11, a brightness value of the pixel unit in the dynamic image display region may be four times of that of the pixel unit in the non-dynamic image display region. Thereby, it is possible to ensure uniformity of display brightness of the display apparatus.

In the embodiment of the present disclosure, the ratio of the duration of the control phase to the duration of the light emitting phase may be adjusted according to a refresh frequency of the display apparatus, actual application requirements, or a display image which is actually to be displayed, which is not limited in the embodiment of the present disclosure.

For example, when the refresh rate of the display apparatus is 60 hertz (HZ), the display duration of one frame of image is 16.7 milliseconds. Generally, when the display duration of one frame of image is reduced to 1 ms, human eyes may not see smear, and therefore the duration of the light emitting phase may be reduced to 1/16 of the display duration of one frame of image, that is, the ratio of the duration of the control phase to the duration of the light emitting phase may be 15:1.

Optionally, the driving apparatus may adjust the ratio of the duration of the control phase to the duration of the light emitting phase according to a dynamic change rate of a display image to be displayed which is transmitted by a system side (for example, a graphics processor). For example, if the dynamic change rate of the display image to be displayed is high, the ratio may be controlled to have a large value. If the dynamic change rate of the display image to be displayed is low, the ratio may be controlled to have a small value.

Here, the dynamic change rate of the display image to be displayed may be a number of display images with different image content in a multi-frame display image to be displayed per unit time.

In step 1043, the voltage value of the data signal is adjusted based on a display grayscale corresponding to the adjusted brightness value.

Finally, the driving apparatus may convert the adjusted brightness value according to the conversion relationship between grayscales and brightness values to obtain a corresponding adjusted display grayscale. Then, the voltage value of the data signal may be adjusted according to the adjusted display grayscale, thereby realizing compensation for the voltage value of the data signal.

Further, the method for driving a pixel circuit according to the embodiment of the present disclosure is described by taking the pixel circuit shown in FIG. 3 as an example and taking each transistor in the pixel circuit being a P-type transistor and the first potential being a low potential with respect to the second potential as an example.

Figure 12:
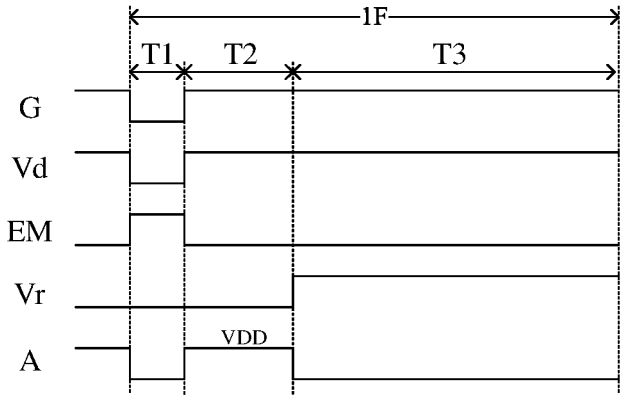
FIG. 12 is a timing diagram of respective signal terminals in a process of driving a pixel circuit according to an embodiment of the present disclosure.

FIG. 12 is a timing diagram of respective signal terminals in a process of driving a pixel circuit according to an embodiment of the present disclosure. As may be seen from FIG. 12, if a display image corresponding to a data signal to be written into a certain pixel unit is a dynamic image, a process of driving a pixel circuit in the pixel unit within a display duration IF of one frame may comprise an input phase T1, a light emitting phase T2, and a control phase T3.

Figure 13:
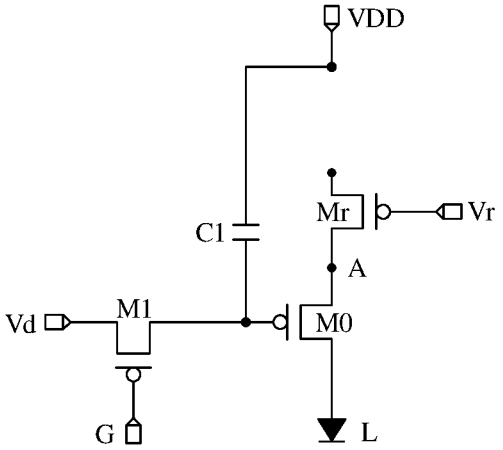
FIG. 13 is an equivalent circuit diagram of a pixel circuit in an input phase according to an embodiment of the present disclosure.

In the input phase T1, a gate driving signal provided by the gate line G, a data signal provided by the data line Vd, and a switch signal provided by the switch signal terminal Vr are all at a first potential, and an enabling signal provided by the light emitting control signal terminal EM is at a second potential. FIG. 13 is an equivalent circuit diagram of a pixel circuit in the input phase according to an embodiment of the present disclosure. As shown in FIG. 13, in the input phase T1, the first control transistor M1 may be switched on under control of the gate driving signal, the data signal is provided to the gate of the driving transistor M0, and the driving transistor M0 is switched on. The first capacitor C1 stores the data signal. The switch transistor Mr may be switched on under control of the switch signal. However, the second control transistor M2 is switched off under control of the enabling signal, and a path between the power signal terminal VDD and the first terminal of the driving transistor M0 is switched off. Therefore, in the input phase T1, a potential at a node A is the first potential, and the light emitting element L does not emit light. As may be seen from FIGS. 3 to 7, the node A may be a node coupled to the second terminal of the switch transistor Mr.

Figure 14:
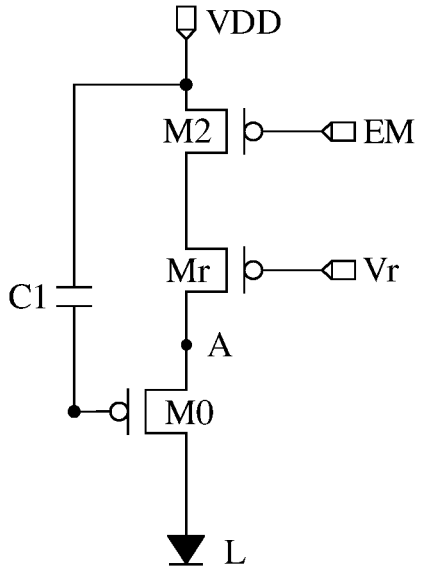
FIG. 14 is an equivalent circuit diagram of a pixel circuit in a light emitting phase according to an embodiment of the present disclosure.

In the light emitting phase T2, as shown in FIG. 12, the gate driving signal provided by the gate line G and the data signal provided by the data line Vd are both at a second potential, and the switch signal provided by the switch signal terminal Vr and the enabling signal provided by the light emitting control signal terminal EM are both at the first potential. FIG. 14 is an equivalent circuit diagram of a pixel circuit in the light emitting phase according to an embodiment of the present disclosure. As shown in FIG. 14, in the light emitting phase T2, the first control transistor M1 is switched off under control of the gate driving signal. The driving transistor M0 is maintained to be in a switch-on state under action of the first capacitor C1, the second control transistor M2 is switched on under control of the enabling signal, and the switch transistor Mr is switched on under control of the switch signal. At this time, the signal path between the power signal terminal VDD and the light emitting element L is switched on, and the potential at the node A is a potential of a power signal. The driving transistor M0 may provide a driving signal, for example, driving current, to the light emitting element L to drive the light emitting element L to emit light under driving of the data signal and a power signal provided by the power signal terminal VDD.

Figure 15:
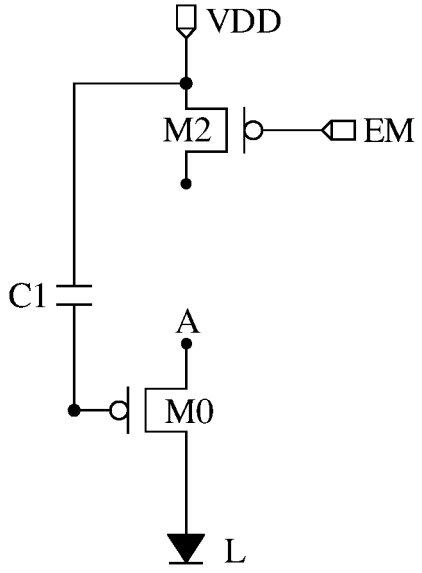
FIG. 15 is an equivalent circuit diagram of a pixel circuit in a light emitting phase according to an embodiment of the present disclosure.

Further, in the control phase T3, the switch signal provided by the switch signal terminal Vr jumps to the second potential, and potentials of signals provided by other respective signal terminals are maintained to be unchanged. FIG. 15 is an equivalent circuit diagram of a pixel circuit in the light emitting phase according to an embodiment of the present disclosure. As shown in FIG. 15, in the control phase T3, the second control transistor M2 and the driving transistor M0 are maintained to be in a switch-on state, but the switch transistor Mr is switched off under control of the switch signal. At this time, the signal path between the power signal terminal VDD and the light emitting element L is switched off, the potential at the node A recovers to the first potential, the driving transistor M0 may not provide the driving signal to the light emitting element L, and the light emitting element L stops emitting light.

Optionally, in the embodiment of the present disclosure, if a display image corresponding to a data signal to be written into a certain pixel unit is a dynamic image, the driving apparatus may control a duration of a pixel circuit in the pixel unit in the light emitting phase T2 and a duration of the pixel circuit in the control phase T3 according to a preset ratio.

For example, as shown in FIG. 12, the ratio of the duration of the control phase T3 to the duration of the light emitting phase T2 may be 3:1, that is, the duration of the light emitting phase T2 is ¼ of the original duration. Correspondingly, when the voltage value of the data signal is adjusted by the driving apparatus, the driving apparatus may adjust the voltage value according to the preset ratio. For example, the voltage value of the data signal may be adjusted, so that light emitting brightness of a light emitting element in the pixel unit is four times of original brightness to ensure uniformity of brightness of the display apparatus.

It should be illustrated that in the above embodiments, description is made by taking each transistor being a P-type transistor and the first potential being a low potential with respect to the second potential as an example. Of course, each of the transistors may also be implemented using an N-type transistor. When each of the transistors is implemented using an N-type transistor, the first potential may be a high potential with respect to the second potential, and a change of a potential at each signal terminal may be opposite to that as shown in FIG. 12, that is, a timing of signals provided by the respective signal terminals is complementary to that shown in FIG. 12.

It should also be illustrated that, in the embodiment of the present disclosure, the pixel circuit may be coupled to each signal terminal through a signal line. For example, the pixel circuit may be coupled to the switch signal terminal through a switch signal line, may be coupled to the power signal terminal through a power signal line, may be coupled to the light emitting control signal terminal through a light emitting control signal line, may be coupled to the reset signal terminal through a reset signal line, and may be coupled to the initialization signal terminal through an initialization signal line.

In summary, the embodiments of the present disclosure provide a method for driving a pixel circuit, which may firstly control the light emitting element to emit light through the driving sub-circuit and the switch sub-circuit and then control the light emitting element to stop emitting light through the switch sub-circuit when the display image corresponding to the data signal provided by the data line is a dynamic image, which may reduce the duration in which the light emitting element emits light, and thus may avoid the occurrence of dynamic smear, thereby ensuring a display effect of the display apparatus.

The embodiments of the present disclosure further provide an apparatus for driving a pixel circuit, which may be used to implement the above driving method.

For example, the driving apparatus may comprise: a driving integrated circuit for providing a switch signal to the switch signal terminal, a gate driving circuit for providing a gate driving signal to the gate line, and a source driving circuit for providing a data signal to the data line.

Optionally, the driving apparatus may further comprise a timing controller, which may be coupled to the driving integrated circuit, and may be used to implement the methods shown in step 103 and step 104 above. Here, the driving integrated circuit may be a circuit independently provided in the display apparatus, or may also be integrated with the source driving circuit.

The embodiments of the present disclosure further provide an array substrate, which may comprise a plurality of pixel units arranged in an array, wherein each of the pixel units may comprise a pixel circuit and a light emitting element coupled to the pixel circuit. A pixel circuit in at least one of the plurality of pixel units may be the pixel circuit as shown in any of FIGS. 1 to 7.

Optionally, a pixel circuit in each of the plurality of pixel units on the array substrate may be the pixel circuit as shown in any of FIGS. 1 to 7.

Figure 16:
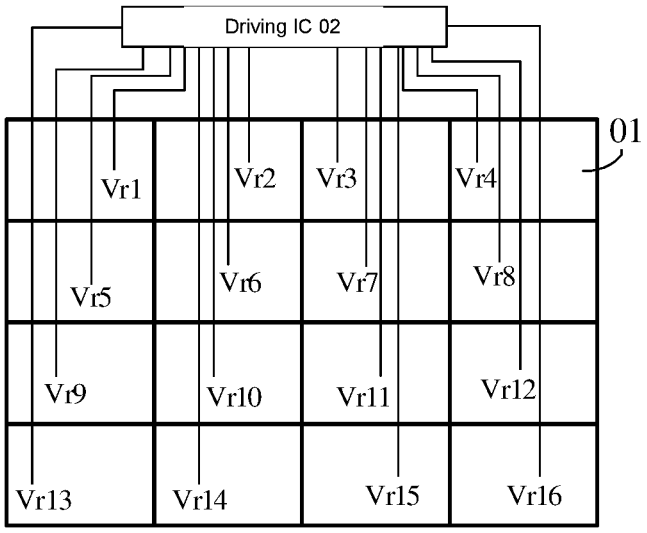
FIG. 16 is a schematic structural diagram of an array substrate according to an embodiment of the present disclosure.

FIG. 16 is a schematic structural diagram of an array substrate according to an embodiment of the present disclosure. As shown in FIG. 16, the array substrate may comprise a plurality of control regions, each of the control regions may have at least one pixel unit provided therein, each of the control regions may have one switch signal line provided therein, each switch signal line is coupled to one switch signal terminal, and different switch signal lines are coupled to different switch signal terminals.

Respective pixel circuits provided in each of the plurality of control regions may be coupled to one switch signal line provided in the control region. That is, respective pixel circuits in each control region may share one switch signal line. The switch signal lines in the respective control regions may be coupled to a driving Integrated Circuit (IC) of the display apparatus, that is, switch signal terminals coupled to the switch signal lines may be signal terminals of the driving IC. The driving IC may be used to control a level of a switch signal provided by each of the switch signal lines. Each pixel circuit in each of the control regions may adjust a light emitting duration of a light emitting element under control of the received switch signal. Thereby, the light emitting duration of each pixel unit in each control region may be controlled independently, which effectively improves the flexibility of the control.

Optionally, as shown in FIG. 16, the plurality of control regions may be arranged in an array on a base substrate. The plurality of switch signal lines may be provided in parallel with data lines in the array substrate, and may be formed using a one-time patterning process together with the data lines.

For example, as shown in FIG. 16, the array substrate may be divided into sixteen control regions, and the driving IC of the display apparatus is coupled to sixteen switch signal lines. Each of the sixteen control regions may correspondingly have one switch signal line provided therein, and the switch signal line is coupled to respective pixel circuits in the control region. For example, as shown in FIG. 16, a control region in a first row and a first column of the array substrate correspondingly has a switch signal line Vr1 provided therein, and respective pixel circuits in the control region are coupled to the switch signal line Vr1. A control region in a fourth row and a fourth column correspondingly has a switch signal line Vr16 provided therein, and respective pixel circuits in the control region are coupled to the switch signal line Vr16.

Figure 17:
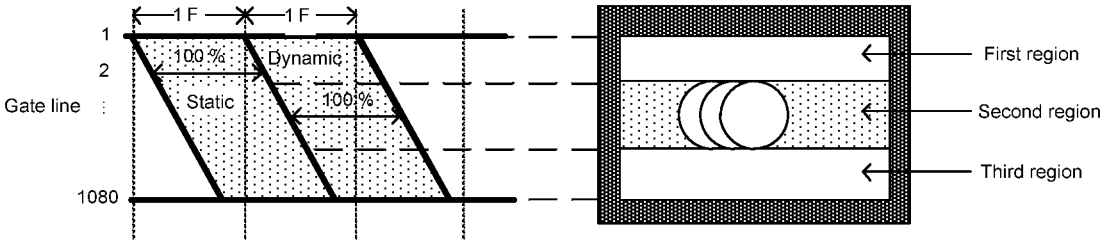
FIG. 17 is a schematic diagram of a driving effect of a pixel circuit in the related art.

FIG. 17 is a schematic diagram of a driving effect of a pixel circuit in the related art. As may be seen from FIG. 17, when a driving apparatus in a display apparatus drives a light emitting element to emit light through a pixel circuit, each pixel circuit may drive a light emitting element to be maintained in a light emitting state within a display duration IF of one frame regardless of whether an image which is currently displayed is a static image or a dynamic image. In this driving mode, dynamic smear may occur when the display apparatus displays a dynamic image. For example, small balls in the display image shown in FIG. 17 have smear.

Figure 18:
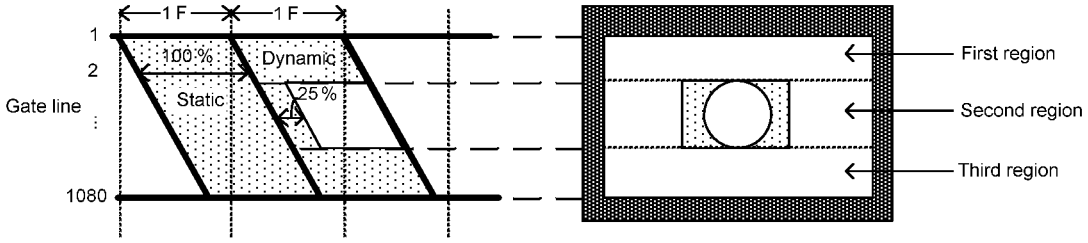
FIG. 18 is a schematic diagram of a driving effect of a pixel circuit according to an embodiment of the present disclosure.

However, in the embodiment of the present disclosure, as shown in FIG. 18, when an image which is currently displayed by a display apparatus is a dynamic image, in a case where a driving apparatus drives a light emitting element to emit light through a pixel circuit, a duration in which the light emitting element is maintained in a light emitting state within a display duration 1F of one frame may be reduced, for example, a light emitting duration of the light emitting element may be reduced to 25% of an original duration. At this time, as shown in FIG. 18, small balls in the display image have no smear, which effectively improves the display effect.

Only a part of the display image displayed by the display apparatus may be a dynamic image, and other parts of the image may be static images. For example, in the display image shown in FIG. 18, images displayed in a first region and a third region are both static images, and only an image displayed in a second region is a dynamic image. Therefore, in the embodiment of the present disclosure, the array substrate is divided into a plurality of control regions, and each of the control regions correspondingly has one switch signal line provided therein, so that only a light emitting duration of a pixel unit in a control region for displaying a dynamic image may be controlled, without adjusting light emitting durations of pixel units of other control regions, which effectively improves the accuracy of the control. Further, after reducing the light emitting duration of the pixel unit, it is necessary to increase light emitting brightness of the pixel unit correspondingly, which may result in an increased power consumption of the display apparatus. Only pixel units in a part of the control regions are adjusted, which may effectively avoid increasing the power consumption of the display apparatus.

The embodiments of the present disclosure provide a display apparatus which may comprise the array substrate as shown in FIG. 16. The display apparatus may be any product or component having a display function such as a liquid crystal panel, an electronic paper, an OLED panel, an AMOLED panel, a mobile phone, a tablet computer, a television, a display, a notebook computer, a digital photo frame, or a navigator etc.

It may be clearly understood by those skilled in the art that for the convenience and brevity of the description, a specific working process of the above-mentioned pixel circuit and each sub-circuit may be known with reference to the corresponding process in the above method embodiment, and details thereof will not be described herein again.

The above description is only exemplary embodiments of the present disclosure, and is not intended to limit the present disclosure. Any modifications, equivalent substitutions, improvements, etc., made within the spirit and principles of the present disclosure should be contained in the protection scope of the present disclosure.

We claim:

1. A pixel circuit comprising:

a driving sub-circuit; and a switch sub-circuit, wherein the driving sub-circuit and the switch sub-circuit are coupled in series between a power signal terminal and a light emitting element, wherein the driving sub-circuit is coupled to a gate line and a data line, respectively, and is configured to provide a driving signal to the light emitting element under control of a gate driving signal provided by the gate line, a data signal provided by the data line, and a power signal provided by the power signal terminal, wherein the switch sub-circuit is coupled to a switch signal terminal, and is configured to control switch-on and switch-off of a signal path between the power signal terminal and the light emitting element under control of a switch signal provided by the switch signal terminal, wherein the power signal terminal and the light emitting element are both coupled to the driving sub-circuit, and wherein the driving sub-circuit comprises at least two transistors which are coupled in series, and the switch sub-circuit is coupled in series between the at least two transistors.

2. The pixel circuit according to claim 1, wherein the power signal terminal is coupled to the switch sub-circuit, and the light emitting element is coupled to the driving sub-circuit.

3. The pixel circuit according to claim 2, wherein the switch sub-circuit comprises a switch transistor, wherein the switch transistor has a gate coupled to the switch signal terminal, a first terminal coupled to the power signal terminal, and a second terminal coupled to an input terminal of the driving sub-circuit, and wherein each of the first terminal and the second terminal is one of a source and a drain, respectively.

4. The pixel circuit according to claim 1, wherein the power signal terminal is coupled to the driving sub-circuit, and the light emitting element is coupled to the switch sub-circuit.

5. The pixel circuit according to claim 4, wherein the switch sub-circuit comprises a switch transistor, wherein the switch transistor has a gate coupled to the switch signal terminal, a first terminal coupled to an output terminal of the driving sub-circuit, and a second terminal coupled to the light emitting element, and wherein each of the first terminal and the second terminal is one of a source and a drain, respectively.

6. The pixel circuit according to claim 1, wherein the switch sub-circuit comprises a switch transistor, wherein the switch transistor has a gate coupled to the switch signal terminal, a first terminal coupled to a second terminal of one of the transistors of the driving sub-circuit, and a second terminal coupled to a first terminal of another of the transistors of the driving sub-circuit, and wherein each of the first terminal and the second terminal is one of a source and a drain, respectively.

7. The pixel circuit according to claim 1, wherein the driving sub-circuit comprises a driving transistor, a first control transistor, a second control transistor, and a first capacitor, wherein the driving transistor, the second control transistor, and a switch transistor contained in the switch sub-circuit are coupled in series between the power signal terminal and the light emitting element;

wherein the first control transistor has a gate coupled to the gate line, a first terminal coupled to the data line, and a second terminal coupled to a gate of the driving transistor;

wherein a gate of the second control transistor is coupled to a light emitting control signal terminal; and wherein the first capacitor has a first terminal coupled to the power signal terminal, and a second terminal coupled to the gate of the driving transistor.

8. The pixel circuit according to claim 1, wherein the driving sub-circuit comprises a third control transistor, a fourth control transistor, a fifth control transistor, a sixth control transistor, a seventh control transistor, an eighth control transistor, a second capacitor, and a driving transistor, wherein the driving transistor, the fourth control transistor, the seventh control transistor, and a switch transistor contained in the switch sub-circuit are coupled in series between the power signal terminal and the light emitting element;

wherein the third control transistor has a gate coupled to the gate line, a first terminal coupled to the data line, and a second terminal coupled to a first terminal of the driving transistor;

wherein a gate of the fourth control transistor is coupled to a light emitting control signal terminal;

wherein the fifth control transistor has a gate coupled to the gate line, a first terminal coupled to a second terminal of the driving transistor, and a second terminal coupled to a gate of the driving transistor;

wherein the sixth control transistor has a gate coupled to a reset signal terminal, a first terminal coupled to an initialization signal terminal, and a second terminal coupled to the gate of the driving transistor;

wherein a gate of the seventh control transistor is coupled to the light emitting control signal terminal;

wherein the eighth control transistor has a gate coupled to the gate line, a first terminal coupled to the initialization signal terminal, and a second terminal coupled to a second terminal of the seventh control transistor; and wherein the second capacitor has a first terminal coupled to the gate of the driving transistor, and a second terminal coupled to the power signal terminal.

9. An array substrate, comprising a plurality of pixel units arranged in an array, each of the pixel units comprising a pixel circuit and a light emitting element coupled to the pixel circuit, wherein a pixel circuit in at least one of the plurality of pixel units is the pixel circuit according to claim 1.

10. A display apparatus comprising the array substrate according to claim 9 and a driving apparatus configured to:

in a light emitting phase:

provide a switch signal at a first potential to a switch signal terminal, control, by a switch sub-circuit, a signal path between a power signal terminal and a light emitting element to be switched on under control of the switch signal, output, by a driving sub-circuit, a driving signal to the light emitting element under driving of a data signal provided by a data line and a power signal provided by the power signal terminal, and emit, by the light emitting element, light, wherein a display image corresponding to the data signal is a dynamic image; and in a control phase:

provide a switch signal at a second potential to the switch signal terminal, control by the switch sub-circuit, the signal path between the power signal terminal and the light emitting element to be switched off under control of the switch signal, and stop, by the light emitting element, emitting light.

11. An array substrate, comprising a plurality of pixel units arranged in an array, each of the pixel units comprising a pixel circuit and a light emitting element coupled to the pixel circuit, wherein a pixel circuit in each of the plurality of pixel units is the pixel circuit according to claim 1;

wherein the array substrate comprises a plurality of control regions, each of the control regions having at least one of the pixel units provided therein, each of the control regions having one switch signal line provided therein, each switch signal line being coupled to one switch signal terminal, and different switch signal lines being coupled to different switch signal terminals; and wherein at least one of the pixel units provided in each of the control regions comprises pixel circuits coupled to one switch signal line provided in the control region.

12. The array substrate according to claim 11, wherein the plurality of control regions are arranged in an array.

13. The array substrate according to claim 12, wherein each of the switch signal lines is provided in parallel with a data line in the array substrate.

14. A method for driving a pixel circuit that comprises a driving sub-circuit and a switch sub-circuit, wherein the driving sub-circuit and the switch sub-circuit are coupled in series between a power signal terminal and a light emitting element, wherein the driving sub-circuit is coupled to a gate line and a data line, respectively, and is configured to provide a driving signal to the light emitting element under control of a gate driving signal provided by the gate line, a data signal provided by the data line, and a power signal provided by the power signal terminal, wherein the switch sub-circuit is coupled to a switch signal terminal, and is configured to control switch-on and switch-off of a signal path between the power signal terminal and the light emitting element under control of a switch signal provided by the switch signal terminal, wherein the power signal terminal and the light emitting element are both coupled to the driving sub-circuit, and wherein the driving sub-circuit comprises at least two transistors which are coupled in series, and the switch sub-circuit is coupled in series between the at least two transistors, the method comprising:

in a light emitting phase:

providing a switch signal at a first potential to a switch signal terminal, controlling, by a switch sub-circuit, a signal path between a power signal terminal and a light emitting element to be switched on under control of the switch signal, outputting, by a driving sub-circuit, a driving signal to the light emitting element under driving of a data signal provided by a data line and a power signal provided by the power signal terminal, and emitting, by the light emitting element, light, wherein a display image corresponding to the data signal is a dynamic image; and in a control phase:

providing a switch signal at a second potential to the switch signal terminal, controlling, by the switch sub-circuit, the signal path between the power signal terminal and the light emitting element to be switched off under control of the switch signal, and stopping, by the light emitting element, emitting light.

15. The method according to claim 14, wherein before the light emitting phase, the method further comprises:

detecting whether the display image corresponding to the data signal is a dynamic image; and in response to detecting that the display image is a dynamic image, performing the light emitting phase and the control phase sequentially.

16. The method according to claim 15, wherein in response to detecting that the display image is a dynamic image, the method further comprises:

before the light emitting phase, adjusting a voltage value of the data signal according to a ratio of a duration of the control phase to a duration of the light emitting phase.

17. The method according to claim 16, wherein the step of adjusting a voltage value of the data signal according to a ratio of a duration of the control phase to a duration of the light emitting phase comprises:

determining, according to a conversion relationship between grayscales and brightness values, a brightness value corresponding to a display grayscale of the data signal;

adjusting the brightness value according to the ratio of the duration of the control phase to the duration of the light emitting phase; and adjusting the voltage value of the data signal based on a display grayscale corresponding to the adjusted brightness value.

18. The method according to claim 14, wherein before the light emitting phase, the method further comprises:

in an input phase:

providing a gate driving signal at the first potential to a gate line, providing the data signal to the data line, and storing, by the driving sub-circuit, the data signal under control of the gate driving signal.

19. An apparatus for driving a pixel circuit, configured to implement the method according to claim 14.

* * * * *